United States Patent [19]

Theurer et al.

[11] 4,245,703

[45] Jan. 20, 1981

[54] MOBILE BALLAST CLEANING MACHINE

[75] Inventors: Josef Theurer, Vienna; Karl Fölser, Linz-Urfahr, Austria

[73] Assignee: Franz Plasser Bahnbaumaschinen-Industriegesellschaft m.b.H., Vienna, Austria

[21] Appl. No.: 961,566

[22] Filed: Nov. 17, 1978

[30] Foreign Application Priority Data

Dec. 29, 1977 [AT] Austria ..... 9416/77

[51] Int. Cl.[3] ..... E01B 27/00

[52] U.S. Cl. ..... 171/16

[58] Field of Search ..... 171/16; 104/2 R, 7 A; 37/107

[56] References Cited

U.S. PATENT DOCUMENTS

| | | | |
|---|---|---|---|
| 1,576,093 | 3/1926 | Cooke | 171/16 |
| 2,791,410 | 5/1957 | Allemann | 171/16 |
| 3,612,184 | 10/1971 | Plasser et al. | 171/16 |
| 3,872,929 | 3/1975 | Teurer et al. | 171/16 |
| 3,976,142 | 8/1976 | Plasser et al. | 171/16 |

FOREIGN PATENT DOCUMENTS

| | | | |
|---|---|---|---|
| 2612536 | 10/1976 | Fed. Rep. of Germany | 171/16 |
| 677923 | 8/1952 | United Kingdom | 171/16 |
| 1067465 | 5/1967 | United Kingdom | 171/16 |

*Primary Examiner*—Jay N. Eskovitz
*Attorney, Agent, or Firm*—Kurt Kelman

[57] ABSTRACT

A mobile ballast cleaning machine comprises a ballast excavating chain, a screening apparatus including a series of screens arranged to receive the excavated ballast and to clean it, a storage receptacle for the cleaned ballast, the storage receptacle having ballast outlets, and hinged covers over the outlets for selectively closing the same by means of jacks, and a ballast conveyor arrangement for controllably redistributing the cleaned ballast to the ballast bed, the ballast redistributing conveyor arrangement being arranged to receive the cleaned ballast from the outlets upon adjustment of the hinged covers.

13 Claims, 3 Drawing Figures

MOBILE BALLAST CLEANING MACHINE

Figure 1:
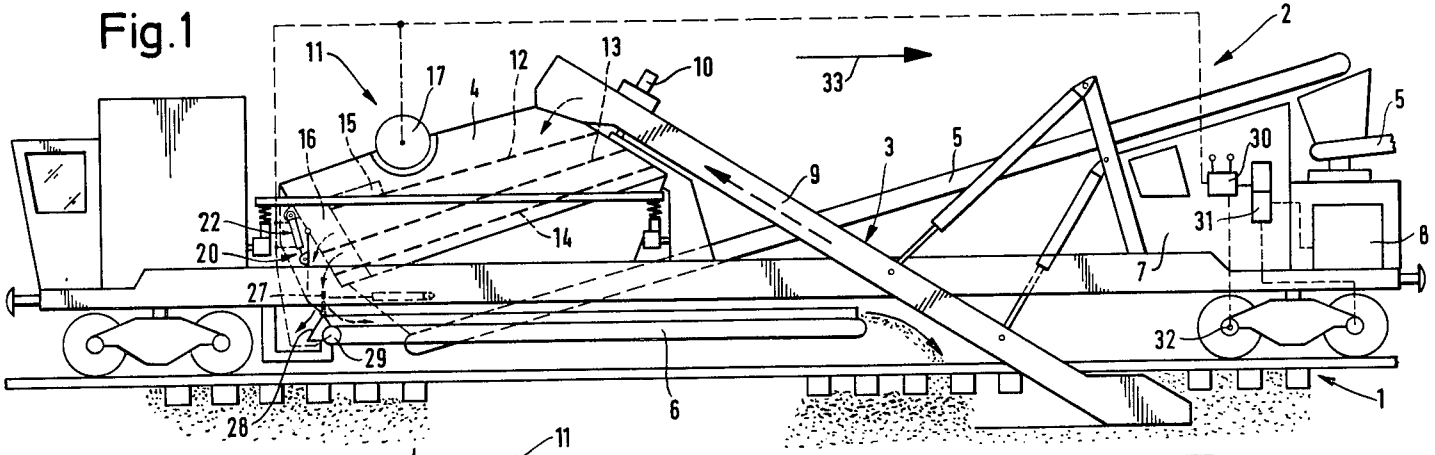

The present invention relates to improvements in a mobile ballast cleaning machine which comprises means for removing ballast from a ballast bed, the ballast removing means having an output, screening means arranged to receive the removed ballast from the output and to clean the removed ballast, a storage receptacle for the cleaned ballast, the storage receptacle having ballast outlet means, and means including ballast conveyor means for controllably redistributing the cleaned ballast to the ballast bed, the ballast redistributing means being arranged to receive the cleaned ballast.

Our U.S. Pat. No. 3,976,142, dated Aug. 24, 1976, discloses a ballast cleaning machine of this general type. In this machine, an endless ballast excavating chain is arranged to extend transversely underneath a lifted track section for removing ballast from the ballast bed and to move the ballast to be cleaned to a ballast cleaning screening arrangement comprised of vibratory screens separating rubble from the ballast. The cleaned ballast is then controllably conveyed and redistributed in the ballast bed. To enable the uneven supply of cleaned ballast to be equalized over an extended operating range, a ballast storage receptacle is provided for the cleaned ballast, this receptacle being arranged in the conveying path near the discharge end. Since the discharge end usually is positioned normally about centrally between the front and rear undercarriages of the machine frame and the stored ballast is quite heavy, this arrangement subjects the entire frame to a considerable load.

Another problem arises in connection with this machine. When it is stopped, ballast removal by the excavating chain is either entirely interrupted or slowed down considerably because the high ballast resistance will reduce the speed of the moving excavating chain. The redistributing conveyors, on the other hand, continue to operate at least partially, which often creates malfunctioning. While the excavating chain stops or slows down, the redistributing conveyors will cause cleaned ballast in transit to be discharged in a relatively small area where it will accumulate. This problem arises even when the machine advances only slowly along the track. The accumulated cleaned ballast is then missed in the subsequent stage of operation when full-speed advancement of the machine is resumed since it takes some time before a new supply of cleaned ballast is conveyed to the discharge end. In addition, the accumulated ballast may make it difficult or impossible for the machine to advance. Furthermore, since large amounts of ballast are treated and conveyed, a true storage of cleaned ballast is impossible since this would increase the above-mentioned load on the machine frame beyond an acceptable extent.

These disadvantages of the machine are noticeable particularly during cleaning of ballast in the range of track branches and switches since the increased width of the ballast bed in such areas produces correspondingly increased amounts of ballast to be cleaned and conveyed.

An attempt has been made to overcome the disadvantages of ballast accumulation during stoppage of such a mobile ballast cleaning machine. According to German patent application No. 2,612,536, published Oct. 14, 1976, a track-bound ballast distributing apparatus is arranged in the range of the ballast discharge end and this apparatus has at least two closable outlets in its bottom. The capacity of this apparatus is such that it corresponds at least to that volume of ballast present at any time during operation on the excavating chain, the cleaning screen and the redistributing conveyor system. Such a track-bound apparatus, therefore, must be constructed and dimensioned for such a massive ballast storage capacity. The large weight of stored ballast concentrated in a small space and the required dimensioning of the apparatus pose considerable problems in view of the very limited space available in the area where the cleaned ballast is discharged and distributed over the ballast bed, and the fastening elements attaching the apparatus to the machine frame, the drive for the machine and the machine frame itself are subjected to excessive loads, the strains being particularly pronounced when the machine is started after it has been stopped.

U.S. Pat. Nos. 2,791,410, dated May 7, 1957, and 3,872,929, dated Mar. 25, 1975, as well as British Pat. No. 1,067,465, published May 3, 1967, disclose various mobile ballast cleaning machines of the general type herein disclosed, wherein movable baffles or guides are provided to direct the cleaned ballast coming from the cleaning screen.

It is the primary object of this invention to improve a mobile ballast cleaning machine of the indicated type so as to overcome the cited disadvantages in an economical manner and, more particularly, to enable ballast to be stored at a time when the machine is stopped or its advancement is slowed without subjecting the machine to undue loads.

The above and other objects are accomplished in accordance with the invention with a ballast screening apparatus which includes not only the screening means but also the storage receptacle for the cleaned ballast. The storage receptacle has ballast outlet means, closure means for selectively closing the outlet means and control drive means for adjusting the closure means.

With this very simple solution, wherein the ballast screening apparatus doubles as ballast storage, it is possible to store the ballast present in the conveying path at a time when the machine is stopped over a much larger area. No additional reinforcement is needed for the machine frame since the screening means is always so constructed that it is capable of sustaining the load of any amount of ballast to be cleaned. The arrangement according to the present invention prevents accumulation of ballast in the ballast bed after the machine is stopped without requiring substantial additional structures and further storage means at the discharge end of the ballast conveying path are not needed. This enhances access to the ballast redistributing means at this point and facilitates servicing, thus improving not only the ballast storage but unexpectedly also the distribution of the cleaned ballast. The entire procedure is greatly simplified and servicing of the machine made easier.

With a central arrangement of the screening apparatus on the machine frame, conveyance of the ballast may be interrupted rapidly upon stoppage of the machine and the adjustment and control of the ballast redistributing means may remain unchanged. This makes it possible to make the distribution of cleaned ballast in the ballast bed even and uninterrupted after a stoppage.

Figure 3:
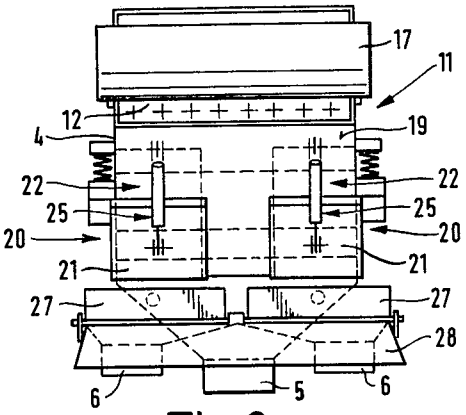
Figure 2:
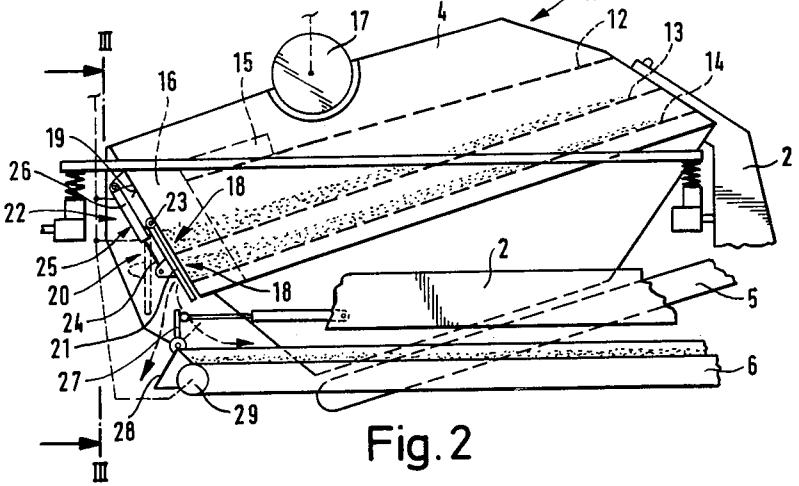

The above and other objects, advantages and features of the present invention will become more apparent from the following detailed description of a now preferred embodiment thereof, taken in conjunction with the accompanying somewhat schematic drawing wherein FIG. 1 is a side elevational view of a mobile ballast cleaning machine, showing only the essential parts thereof in simplified illustration, FIG. 2 illustrates the screening apparatus also shown in FIG. 1 on an enlarged scale, together with the ballast control and distribution elements arranged in the conveying path; and FIG. 3 is a front view of the screening apparatus, as seen in the direction of line III—III of FIG. 2.

Referring now to the drawing, mobile ballast cleaning machine 2 comprises a frame running on front and rear undercarriages on track 1. As well known, for example, from U.S. Pat. No. 3,976,142, whose entire disclosure is incorporated herein by way of reference, the machine frame carries means 3 for removing ballast from the ballast bed supporting the track, screening means 4 arranged to receive the removed ballast from the output of the ballast removing means, means including ballast conveyor 6 for controllably redistributing the cleaned ballast to the ballast bed, and conveyor 5 for carrying away oversized ballast and rubble separated from the ballast received by the screening means. The machine frame also carries central operator's cab 7 and a power source 8.

As conventional, ballast removing means 3 comprises an endless scraper chain running in two obliquely inclined, longitudinally extending guide members holding the removed ballast while it is transported upwardly by the chain driven by dredger drum 10, the two longitudinally extending guide members being positioned laterally of the track rails and the lower ends thereof being connected by a guide for the chain extending transversely of the track and digging into the ballast. Where the power source is a hydraulic fluid supply, it will be useful to drive the dredger drum hydraulically. To enable the ballast excavating chain to be used for various ballast bed widths, for instance in switches, the length of the transverse chain guide is preferably adjustable, as is also known.

In accordance with this invention, screening apparatus 11 includes not only screening means 4 but also a receptacle for the cleaned ballast housing the screening means. In the illustrated embodiment, the screening means comprises a plurality of screen bottoms 12, 13 and 14 arranged in series, for separating ballast of a desired and successively smaller size acceptable for a track ballast bed from fines, including rubble, dirt and the like. First and uppermost screen 12 retains a coarse portion of the ballast received from the output of the ballast excavating chain. This portion is constituted by oversized ballast and is guided by baffle or guide 15 from screen 12 to chute 16 in the receptacle adjacent end wall 19 thereof. The chute receives and removes the coarse ballast portion from the first screen and discharges it directly on conveyor 5 which also receives the fines and dirt from the screening means and moves all of this unwanted material away. Succeeding screen bottom 13 has a mesh size dimensioned to prevent medium-sized ballast from passing therethrough, i.e. ballast in the upper range of the acceptable size. The residual ballast portion passing through screen 13 reaches screen bottom 14 designed to retain smaller-sized ballast and to separate the same from the undesired rubble which is directed into chute 16 for removal. The separation of the removed ballast into its various portions is enhanced by providing drive 17 for vibrating the screens. The vibrating drive is mounted on the screening apparatus housing which, in turn, is supported by a carrier frame mounted on the machine frame on four coil spring shock absorbers. Respective pairs of the shock absorbers respectively adjacent the output of the excavating chain and the end wall of the storage receptacle are supported on transversely extending trusses. These trusses are supported on the machine frame intermediate their ends by pivots extending in the direction of the longitudinal extension of machine 2. In this manner, the trusses may be inclined in relation to the machine frame, for instance by means of hydraulically operable jacks having their respective ends connected to the machine frame and the trusses. By suitably pivoting the support trusses, it is possible to maintain screening apparatus 4 always in a horizontal postion even when the machine operates in a superelevated track curve, i.e. when machine 2 itself in inclined relative to a horizontal plane. The vibrating drive is usually consitituted by eccentric bodies rotatable preferably by hydraulic motors if power source 8 is a hydraulic fluid supply. Rotation of the eccentric bodies will vibrate the screening apparatus in relation to the support trusses mounting the apparatus on the machine frame.

As most clearly shown in FIG. 2, screening apparatus 11 includes a storage receptacle for the cleaned ballast and the receptacle has outlet means 18, and closure means 20 for selectively closing the outlet means and control drive means 22 for adjusting the closure means. The outlet means is associated with each one of screen bottoms 13 and 14. In the illustrated embodiment, outlet means 18 is defined in end wall 19, closure means 20 is a hinged cover means mounted on the end wall over the outlet means, and control drive means is a pressure fluid operated jack means 25 connected respectively to the end wall and the hinged cover means. The hinged cover means comprises pivot means 23 extending transversely to the longitudinal extension of the machine. As best shown in FIG. 3, the hinged cover means is comprised of hinged covers 21 respectively mounted on end wall 19 on each side of chute 16, i.e. a pair of outlets is arranged symmetrically in line with respective halves of screens 13 and 14. Pivots 23 extend in the range of the plane of first screen 12 and hinged covers 21 extend downwardly from their pivots. Associated with each hinged cover, the pressure fluid operated jack means comprises cylinder 26 linked to end wall 19 above a respective pivot 23 and piston rod 24 linked to end wall 19 above a respective pivot 23 and piston rod 24 linked to a respective one of the hinged covers substantially in the center thereof. The jacks enable the hinged covers to be adjusted about pivots 23 between a fully closed position shown in full lines in FIG. 2 to an open position shown in broken lines in FIG. 2 but in full lines in FIG. 1. Baffles 27 are mounted below outlet means 18 to guide the cleaned ballast suitably, the baffles being adjustable for directing the ballast in different pivotal positions towards ballast distributing conveyor 6 and ballast distributing chute 28.

Hinged covers provide very simple closure means and mounting them on an end wall of the ballast storage receptacle which defines the ballast outlets enables the ballast to be stored immediately before it is redistributed to various parts of the bed, including, for example, the center of the track bed and the embankment. Therefore, no interruption of the ballast conveyance is required when the machine is stopped so that, during these periods in which the speed of advancement of the machine changes, a fully uniform distribution of ballast over all areas of the track bed is assured.

With the arrangement of the hinged covers on pivots extending substantially in the plane of the uppermost screen, the covers hanging on these pivots will be under the pressure of the weight of the stored ballast at the end of the storage period, which pressure will assist the opening movement of the covers at that time. At the same time, the weight of the covers will assist in the closing movement. Therefore, this preferred and illustrated arrangement will avoid jamming of the closure means, particularly when large amounts of ballast are stored. Connecting the jacks for opening and closing the hinged covers in the described and illustrated manner will assure that the pivoting pressure of the jacks will exert a minimal flexure force on the covers since they are connected at the center of the covers.

With the symmetrically arranged hinged covers 21 and independently operable control drive means 22, each half of the screens has its own closure means 20. As shown in FIG. 3, a respective ballast conveyor 6 and independently operable baffle guide 27 is associated with each closure means. This enables the cleaned and stored ballast to be distributed over the entire width of the track, particularly in superelevated track curves. Independent adjustment of the closure means makes it possible, for example, to remove more cleaned ballast from the side of the screen inside the curve, where more ballast will be accumulated due to the inclination of the screens due to the superelevation of the track, than from the other half of the screen.

The illustrated machine is hydraulically operated and power source 8 is a hydraulic fluid supply connected by a hydraulic fluid supply circuit (shown in broken lines in FIG. 1) to cylinder 26 of closure means adjustment drives 22, to drive 29 of ballast conveyor 6, to vibration drive 17 for screening apparatus 11 and to drive 32 for machine 2. Control means 30 is operable from operator's cab 7 and includes a control 31 to generate a control signal for actuating the drives, the control signal operating valves in the hydraulic fluid supply circuit for controlling the flow of the fluid to the respective drives from hydraulic fluid supply 8. The control is operable to generate independent control signals for each of the jacks of the closure means adjustment drives. Control 31 is responsive to a signal emitted from a signal emitter on one of the wheel axles so as to actuate the control when the machine is stopped so that the ensuing control signals generated by control 31 may operate jacks 25 by remote control.

If desired, the control panel in operator's cab 7 may also include controls for the remote control of dredger drum 10, of the illustrated jacks connected to excavating chain guides 9 for repositioning the guides, if desired, and of a non-illustrated drive for waste conveyor 5.

The automatic control of the closure means adjustment in response to the stoppage of the machine assures that the moving ballast is halted in its conveying path at such time without involving the operating personnel and thus avoiding operating errors. This will avoid the disturbing ballast accumulations due to sudden stoppage of the machine. Furthermore, full remote control from a central cab of all essential machine drives is assured and the selective and independent operation of the separate closure means makes it possible to direct the stored ballast properly into the redistribution path. The simultaneous remote control of drive 29 for the ballast distributing conveyor, preferably in cooperation with the ballast guiding baffles 27 which are adjustable, makes it possible to block any distribution of cleaned ballast to the ballast bed when the machine is stopped since the cleaned ballast is not conveyed. If the remote control extends to vibration drive 17 of the screening apparatus, the screening apparatus will be protected from overloads while it serves its storing function and power will be saved. The quality of ballast cleaning will not be reduced thereby since no new cleaned ballast is distributed during stoppage of the machine and the cleaned ballast requires no further treatment.

The operation of mobile ballast cleaning machine 2 will be understood from the above description of its structure and will be explained in more detail hereinbelow.

While the machine advances more or less continuously along the track in the operating direction indicated by arrow 33, the moving excavating chain of ballast removal means 3 takes up and moves upwardly in one of the chain guides 9 the dirty ballast and discharges it in the range of dredger drum 10 onto first screen 12. There, the oversized ballast is retained and removed through chute 16 while the medium and small-sized ballast is separated from the rubble on successive screens 13 and 14, the rubble and oversized ballast being carried away by conveyor system 5 to be deposited on the embankment next to the track or loaded onto freight cars coupled to the machine. The useful, cleaned ballast falls through open outlets 18 (see FIG. 2) in end wall 19 and, depending on the positioning of guide baffles 27, is directed either exclusively to distributing conveyor 6 for discharging the cleaned ballast near the point where the ballast has been excavated or to ballast distributing chute 28, or partially to both ballast redistributing devices. Conveyor 6 distributes the cleaned ballast to the excavated portion of the bed to fill the bed with ballast under the ties for support of the track while chute 28 serves to fill the cribs with ballast. Adjustment of the baffle guides 27 enables the respective amounts of cleaned ballast discharged by conveyor 6 and/or chute 28 to be regulated.

When the advancement of machine 2 in the direction of arrow 33 slows down, particularly due to increased resistance of a heavily encrusted ballast bed to excavation, or when the machine is stopped, for instance to lengthen or shorten the excavating chain and guide, operation of screening apparatus 11 as ballast storage assures a continuous uniform distribution of ballast and prevents an undesired accumulation of ballast at the discharge ends of conveyor 6 or chute 28. The operator in cab 7 does this by operation of control 30 or it is done automatically by control element 31 responsive to a change in the speed of the machine or its stoppage. The resultant control signal operates respective valves in the hydraulic fluid supply line to permit hydraulic fluid to flow from tank 8 to a respective jack 25 to close hinged covers 21 either partially in response to a slow-down or completely in response to a full stop of the machine. The partial or complete closure of the hinged covers will serve to store cleaned ballast in the housing of screening apparatus 11 so that less or no cleaned ballast will flow through outlets 18 into the ballast conveying path. At the same time, the control signal will slow down or completely interrupt hydraulic fluid flow to drive 29 so that conveyor 6 will move more slowly or stop corresponding to the slow-down or stoppage of machine 2.

As soon as the machine assumes its original speed after a slow-down or when it is started after a stoppage, the hinged covers are opened again manually or automatically and movement of ballast conveyor 6 is resumed, the opening of the covers and the speed of the conveyor being so regulated that a steady flow of cleaned ballast is assured as increased amounts of ballast are cleaned in the screening apparatus upon full resumption of speed. In this manner, the cleaned ballast will be redistributed in the ballast be uniformly over the entire track section being renewed, regardless of the forward speed of the ballast cleaning machine.

Obviously, when the machine speed is reduced, for example, as the machine advances in the direction of arrow 33, the extent of the opening of hinged covers 21 and/or the speed of conveyor drive 29 may be so controlled that the cleaned ballast in the conveying path may be redistributed in the ballast bed in amounts in proportion to the forward speed of the machine.

Also, to avoid overloads on the cleaning screens and unnecessary expenditure of power, supply of hydraulic fluid to vibration drive 17 will be interrupted at the same time that hinged covers 21 are closed.

As will be seen in FIG. 2, the positioning of ballast baffle guides 27 may remain unchanged when outlets 18 are closed so that, immediately upon resumption of the forward movement of machine 2, the stored cleaned ballast may be redistributed under essentially unchanged conditions. Furthermore, the independent operation of jacks 25 for closing hinged covers 21 at respective sides of the screens will assure even distribution of cleaned ballast in super-elevated track curves, too, when the inclination of the screening apparatus causes an uneven distribution of stored ballast in the apparatus. Selective opening of the covers makes it possible to cause the desired amounts of ballast to flow towards respective sides of the track.

Additionally, when the control 30 is connected also to drive 32 for machine 2, the forward speed of the machine and the positioning of hinged covers 21 may be fully synchronized.

While a common hinged cover 21 has been used for the outlets from screens 13 and 14 in the illustrated embodiment, it will be understood that separate closures may be used for the respective outlets from the screens, each being independently operated by a separate jack, if desired. Furthermore, pivoted closures could be replaced by sliding doors moved in guides parallel to end wall 19.

Finally, the use of a ballast screening apparatus serving as ballast storage is not limited to the described and illustrated embodiment of ballast cleaning machine. Any type of ballast removal means may be used and the control drive means for the closure means of the storage receptacle may take any suitable form, including such mechanical means as threaded spindles, cable drives or simple manual operation. Also, any number of cleaning screens may be used and, if desired, no screen for removing oversized ballast need be provided. Furthermore, the ballast redistributing means may take any desired form and is not limited to the illustrated conveyor 6 and chute 28.

What is claimed is:

1. A mobile ballast cleaning machine comprising (a) means for removing ballast from a ballast bed, the ballast removing means having an output, (b) a screening apparatus including (1) screening means arranged to receive the removed ballast from the output and to clean the removed ballast, the screening means comprising at least two superposed and vertically spaced screens arranged one above the other, (2) a storage receptacle for the cleaned ballast housing the screening means, the storage receptacle having an end wall defining ballast outlet means and the two superposed screens extending substantially the width of the receptacle wherein they are housed, and (3) closure means for selectively closing the outlet means, the closure means being a cover adjustably mounted on the end wall over the outlet means and a pressure fluid operated jack means connected respectively to the end wall and the cover for adjusting the cover, (c) a pressure fluid source connected to the jack means, (d) a remote control means to generate a control signal for actuating the jack means by the pressure fluid from said source, and (e) means for redistributing the cleaned ballast to the ballast bed, the ballast redistributing means being arranged to receive the cleaned ballast selectively from the outlet means upon adjustment of the closure means.

2. The mobile ballast cleaning machine of claim 1, wherein one of the screens is a screen bottom and the outlet means is associated with the screen bottom.

3. The mobile ballast cleaning machine of claim 1 or 2, wherein the cover is hingedly mounted on the end wall over the outlet means.

4. The mobile ballast cleaning machine of claim 3, wherein the hinged cover means comprises pivot extending transversely to the longitudinal extension of the machine.

5. The mobile ballast cleaning machine of claim 3, wherein the superposed screens comprise a first screen retaining a coarse portion of the ballast received from the output of the ballast removing means a chute in the receptacle adjacent the end wall receiving and removing the coarse ballast portion from the first screen, and a respective one of the hinged covers is mounted on the end wall on each side of the chute.

6. The mobile ballast cleaning machine of claim 5, wherein the hinged covers comprise pivots extending transversely to the longitudinal extension of the machine in the range of the plane of the first screen, the hinged covers extending downwardly from the pivots.

7. The mobile ballast cleaning machine of claim 6, wherein the pressure fluid operated jack means comprises, associated with each of the hinged covers, a cylinder linked to the end wall above a respective one of the pivots and a piston rod linked to a respective one of the hinged covers substantially in the center thereof.

8. The mobile ballast cleaning machine of claim 1, wherein the outlet means comprises a pair of outlets symmetrically arranged in line with respective halves of the screening means, respective covers mounted on the end wall over the outlets, and the jack means comprises respective pressure fluid operated jacks each independently operable for adjusting a respective one of the covers.

9. The mobile ballast cleaning machine of claim 1, wherein the superposed screens arranged in series, and the outlet means comprises a respective outlet associated with each of the screens, respective covers for each of the outlets and an independently operable jack means for each cover.

10. The mobile ballast cleaning machine of claim 1, further comprising a central operator's cab, the control means being operable from the cab.

11. The mobile ballast cleaning machine of claim 10, wherein the ballast redistributing means comprises a ballast conveyor arranged to receive cleaned ballast from the outlet means, the ballast conveyor including a drive, and the control signal for actuating the jack means also controlling actuation of the conveyor drive.

12. The mobile ballast cleaning machine of claim 11, further comprising a vibration drive for the screening means, and the control signal for actuating the jack means also controlling actuation of the screening means vibration drive.

13. The mobile ballast cleaning machine of claim 10, wherein the outlet means comprises a plurality of outlets, respective covers are mounted over the outlets, the jack means comprises jacks each operable independently for adjusting a respective one of the covers, and the control means is operable to generate independent control signals for each of the jacks.

* * * * *